US011225744B2

(12) United States Patent
Kim et al.

(10) Patent No.: US 11,225,744 B2
(45) Date of Patent: Jan. 18, 2022

(54) LAUNDRY TREATMENT MACHINE AND CONTROL METHOD THEREOF

(71) Applicant: LG ELECTRONICS INC., Seoul (KR)

(72) Inventors: Dongcheol Kim, Seoul (KR); Youngjong Kim, Seoul (KR); Hyunyong Jeong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 31 days.

(21) Appl. No.: 16/668,694

(22) Filed: Oct. 30, 2019

(65) Prior Publication Data

US 2020/0131683 A1 Apr. 30, 2020

(30) Foreign Application Priority Data

Oct. 30, 2018 (KR) ..... 10-2018-0130752

(51) Int. Cl.

| | |
|---|---|
| ***D06F 37/20*** | (2006.01) |
| ***D06F 33/48*** | (2020.01) |
| ***D06F 37/24*** | (2006.01) |
| ***D06F 33/00*** | (2020.01) |
| *D06F 105/48* | (2020.01) |

(52) U.S. Cl.

CPC ..... *D06F 33/48* (2020.02); *D06F 33/00* (2013.01); *D06F 37/24* (2013.01); *D06F 2105/48* (2020.02)

(58) Field of Classification Search

CPC ..... D06F 37/203

See application file for complete search history.

(56) References Cited

U.S. PATENT DOCUMENTS

2015/0233037 A1* 8/2015 Kim ..... D06F 35/007 8/137

FOREIGN PATENT DOCUMENTS

KR 10-2018-0103382 9/2018

* cited by examiner

*Primary Examiner* — Jason Y Ko

(74) *Attorney, Agent, or Firm* — KED & Associates LLP

(57) ABSTRACT

A laundry treatment machine may include: a tub; a drum that is rotatably disposed in the tub; an actuator that provides power for rotating the drum; and a balancer device that is disposed at an end where the inlet hole of the drum is formed, and adjusts the center of gravity of the drum that is rotating. The balancer device may include: a main balancer that reduces vibration of the drum by moving in the opposite direction to eccentricity that is generated when the drum is rotated; a first sub-balancer of which an arrangement gap from the main balancer is adjusted in accordance with the degree of eccentricity of the drum; and a second sub-balancer of which an arrangement gap from the main balancer is adjusted in the opposite direction of the first sub-balancer with respect to the main balancer.

7 Claims, 11 Drawing Sheets

LAUNDRY TREATMENT MACHINE AND CONTROL METHOD THEREOF

CROSS-REFERENCE TO RELATED APPLICATION

This application claims priority under 35 U.S.C. § 119 to Korean Application No. 10-2018-0130752 filed on Oct. 30, 2018, whose entire disclosure is hereby incorporated by reference.

BACKGROUND

1. Field

The present disclosure relates to a laundry treatment machine and control method thereof and, more particularly, to a laundry treatment machine including a balancer, and a control method thereof.

2. Background

In general, a laundry treatment machine is a machine that treats laundry through several processes such as washing, spinning, and/or drying. In such a laundry treatment machine, an inner tub is rotatably disposed in an outer tub in which water is supplied, and laundry is supposed to be put into the inner tub.

A laundry treatment machine is equipped with a balancer that reduces unbalance due to eccentric distribution of laundry in a drum. Such a balancer for a laundry treatment machine, a ball balancer or a liquid balancer was used, and the ball balancer and the liquid balancer cannot be manually moved in accordance with rotation of a drum. Accordingly, there is a problem that the drum has to be kept rotating until the ball balancer or the liquid balancer moves to the opposite side of the center of gravity of laundry and unbalance is reduced.

Reduction of vibration using two balancers that actively move has been disclosed in Korean Patent Application Publication No. KR 10-2018-0103382, the subject matter of which is incorporated herein by reference. However, according to this configuration, it is required to separately control two balancers, there is a problem that an error may be generated in the distance between the two balancers due to communication with the two balancers or operation of the two balancers.

The above reference is incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements wherein.

DETAILED DESCRIPTION

Figure 1:
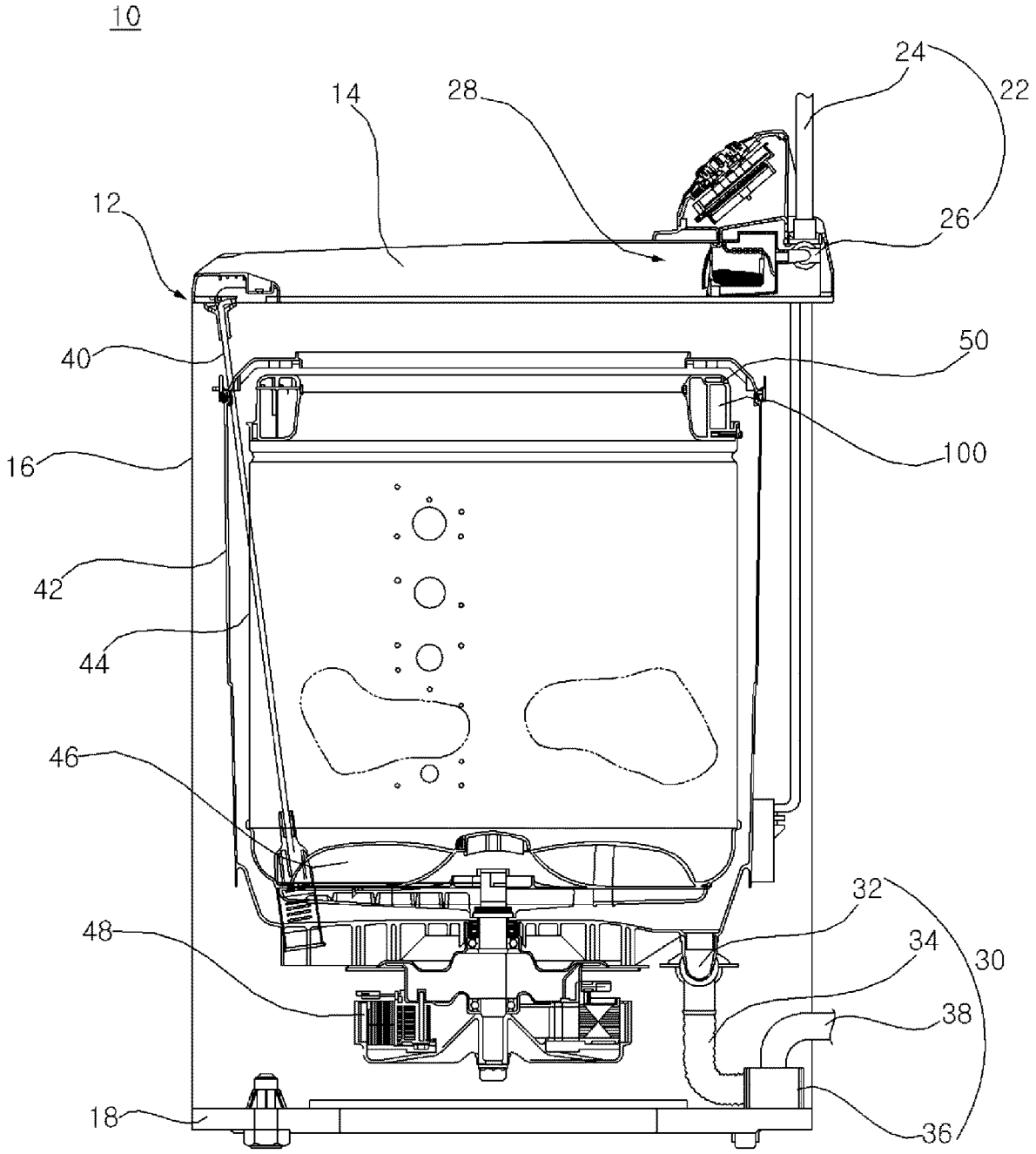
FIG. 1 is a schematic cross-sectional view illustrating the configuration of a laundry treatment machine according to an embodiment of the present disclosure.

The advantages and features of the present disclosure, and methods of achieving them will be clear by referring to the exemplary embodiments that will be describe hereafter in detail with reference to the accompanying drawings. However, the present disclosure is not limited to the exemplary embodiments described hereafter and may be implemented in various ways, and the exemplary embodiments are provided to complete the description of the present disclosure and let those skilled in the art completely know the scope of the present disclosure and the present disclosure is defined by claims. Like reference numerals indicate like components throughout the specification.

Hereafter, a laundry treatment machine according to embodiments of the present disclosure and a method of controlling the laundry treatment machine are described with reference to drawings.

<Entire Configuration>

FIG. 1 is a schematic cross-sectional view illustrating the configuration of a laundry treatment machine according to an embodiment of the present disclosure. The entire configuration of a laundry treatment machine according to the embodiment is described with reference to FIG. 1.

A laundry treatment machine 10 according to the embodiment is a top load type laundry treatment machine 10 in which fabrics are put into a washing tub from above. Such a top load type laundry treatment machine 10 is a concept including a laundry treatment machine 10 that performs washing, rinsing, spinning, etc. on fabrics inserted therein or a drying machine that dries wet fabrics inserted therein, and the laundry treatment machine 10 is mainly described hereafter.

The laundry treatment machine 10 according to the embodiment includes a case 12 forming an external appearance and having an open top, and a door (not shown) for opening/closing the open top of the case 12.

The case 12 has a rectangular prism shape with an open top and an open bottom has a circumferential part 16 forming the circumferential surface, a base part 18 covering the open bottom of the circumferential part 16, and a top cover 14 installed to cover the open top of the circumferential part 16. An inlet hole for putting/taking laundry into/out of the case 12 may be formed at the top cover 14 and the door can cover the inlet hole of the top cover 14.

The laundry treatment machine 10 may include a tub 42 into which washing water is supplied, and a drum 44 rotatably disposed on the tub 42 and receiving laundry. The laundry treatment machine 10 may further include a pulsator 46 that generates vortexes of the washing water in the tub 42. The pulsator 46 is disposed on the bottom of the drum 44. The laundry treatment machine 10 according to the embodiment may include a balancer unit 100 (or balancer device) that compensates for eccentricity that is generated when the drum 44 is rotated. The balancer unit 100 according to the embodiment may include balancers 110, 140, and 150 that compensate for eccentricity due to rotation of the drum 44 by actively moving, and a balancer guide 50 that forms a space in which the balancers 110, 140, and 150 move. The balancers 110, 140, and 150 and the balancer guides 50 are described in detail below.

The laundry treatment machine 10 according to the embodiment includes an actuator 48 providing power for rotating the drum 44 and/or the pulsator 46, and a rotary shaft transmitting the power from the actuator 48 to the drum 44 or the pulsator 46. The laundry treatment machine 10 according to the embodiment may further include a clutch motor (not shown) that selectively transmits the power from the actuator 48 to rotate only the drum 44, rotate only the pulsator 46, or rotate both of the drum 44 and the pulsator 46.

The laundry treatment machine includes a plurality of suspensions 40 hanging the tub 42 at the upper portion in the case 12. An end of each of the suspensions 40 may be coupled to the upper portion in the case 12 and the other end thereof may be coupled to the lower portion of the tub 42. The suspensions 40 may be coupled to the top cover 14 that is one of the components of the case 12. However, they are not limited thereto and may be coupled to any fixed portions of the case 12.

The laundry treatment machine 10 according to the embodiment includes a water supply assembly 22 that supplies washing water into the tub 42, a drain assembly 30 that discharges the washing water in the tub 42 after washing or spinning is finished, and a detergent supplier 28 that temporarily stores additives that act in the washing water, and supplies the additive into the tub 42.

The water supply assembly 22 includes a water supply hose 24 that guides washing water supplied from an external faucet, etc. to the laundry treatment machine 10, and a water supply valve 26 that is connected with the water supply hose 24 to supply or stop washing water.

The drain assembly 30 includes a drain bellows 34 that is connected to the lower portion of the tub 42 and forms a drain channel, a drain valve 32 that connects/disconnects the drain bellows 34, a drain pump 36 that pumps up the washing water flowing in the drain bellows 34 to the outside, and a drain hose 38 that discharges the water pumped up by the drain pump 36 out of a cabinet.

The detergent supplier 28 has a plurality of spaces formed to temporarily store a detergent for washing, a fabric softener for rinsing, etc., and supplies water supplied through the water supply assembly 22 into the tub 42.

<Balancer & Balancer Mover>

Figure 2:
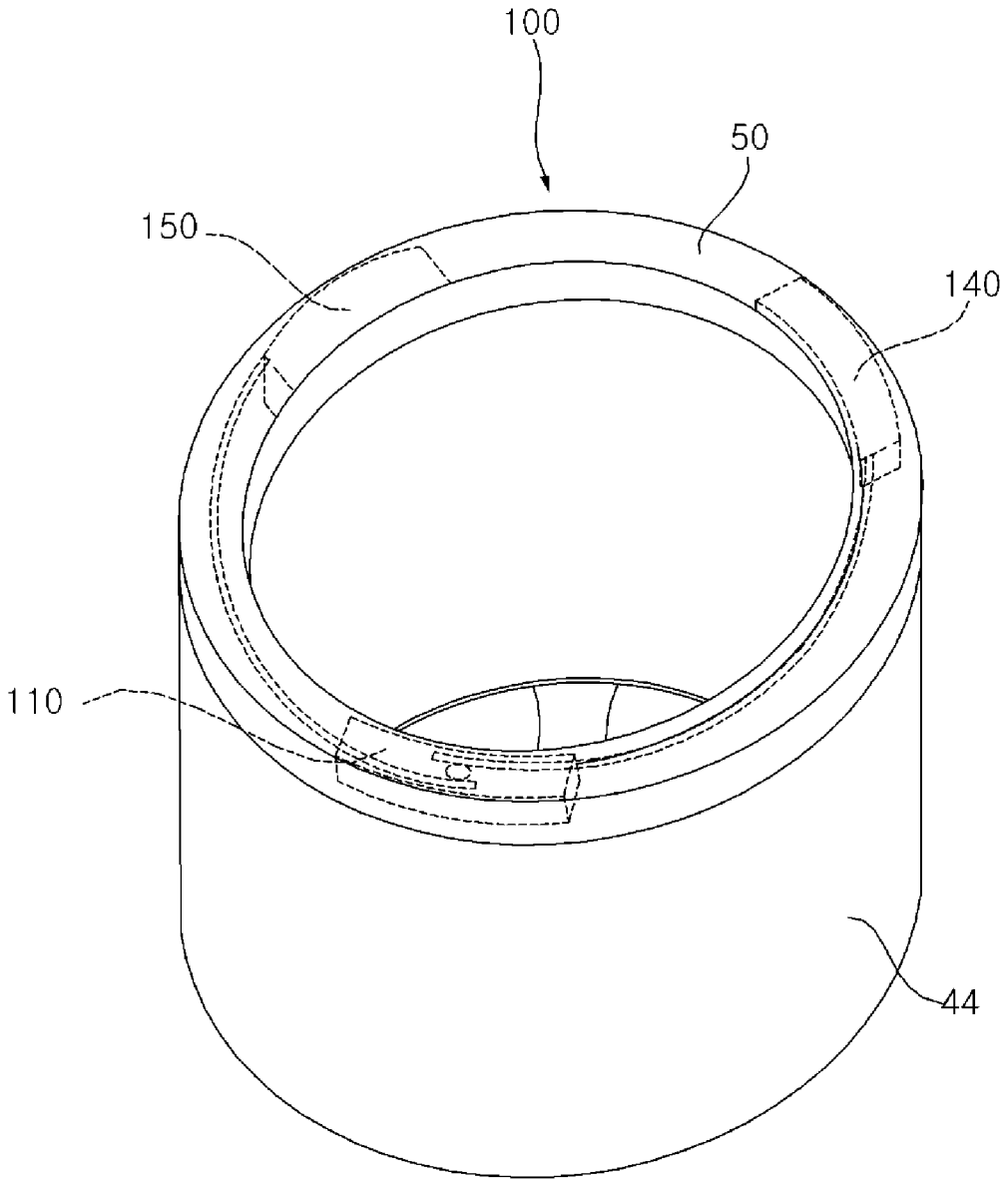
FIG. 2 is a diagram illustrating a drum and a balancer unit according to an embodiment of the present disclosure.
Figure 3:
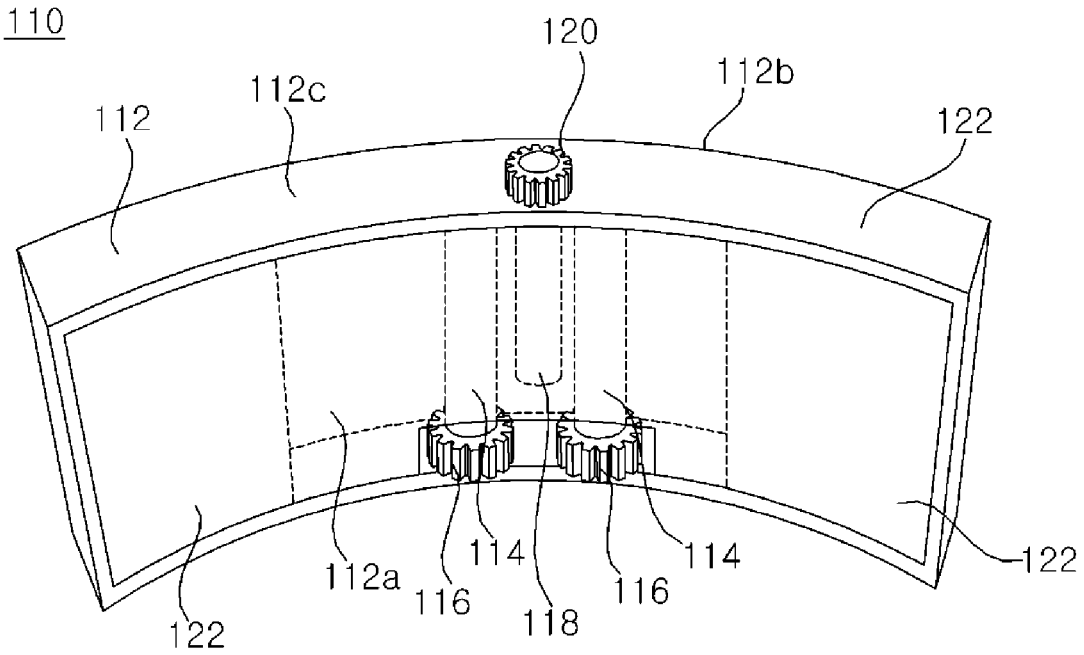
FIG. 3 is a view illustrating the configuration of a main balancer according to an embodiment of the present disclosure.
Figure 4:
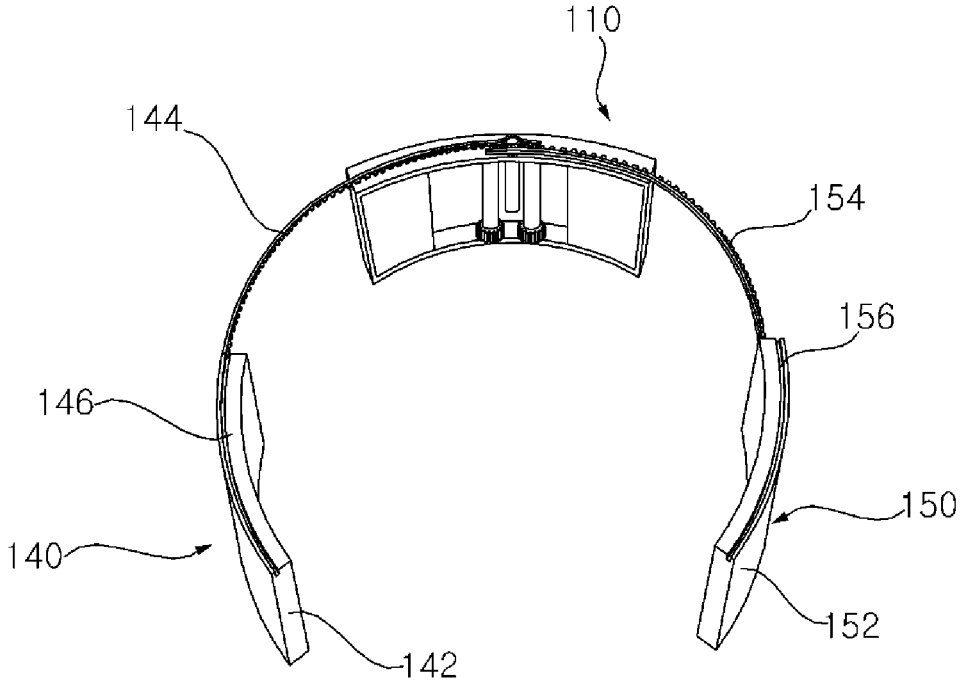
FIG. 4 is a view illustrating the configuration of a main balancer, a first sub-balancer, and a second sub-main balancer according to an embodiment of the present disclosure.
Figure 5A:
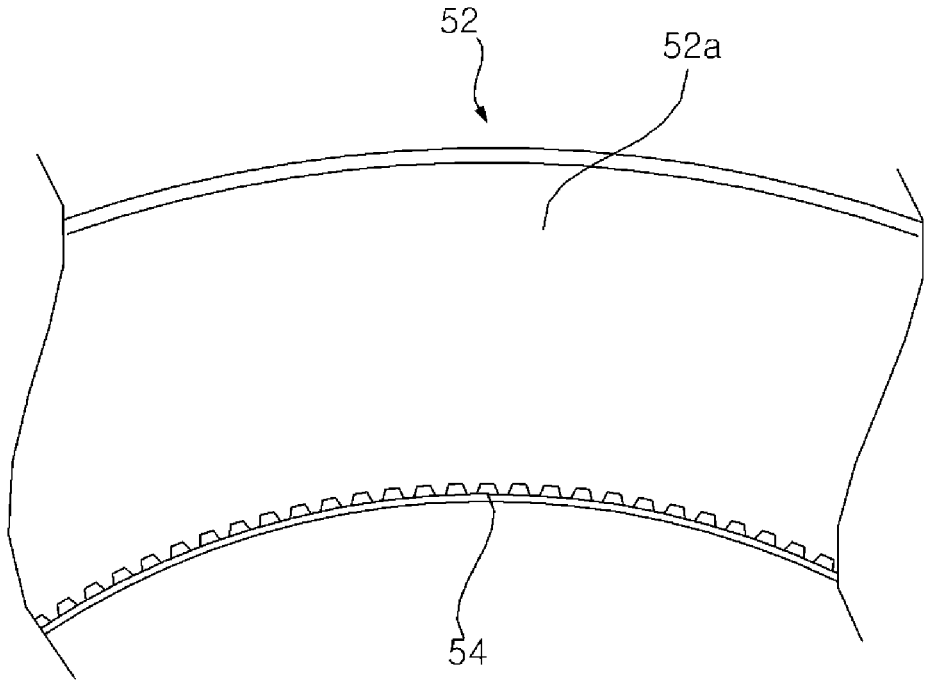
FIG. 5A is a plan view illustrating a first surface of a balancer guide according to an embodiment of the present disclosure.
Figure 5B:
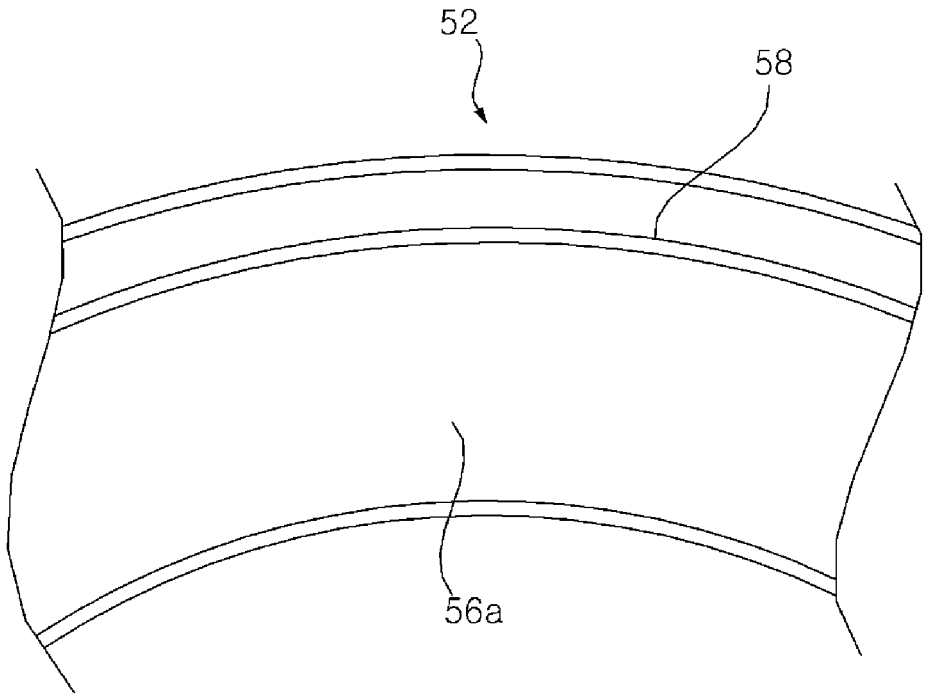
FIG. 5B is a plan view illustrating a second surface of a balancer guide according to an embodiment of the present disclosure.

FIG. 2 is a diagram illustrating a drum and a balancer unit according to an embodiment of the present disclosure. FIG. 3 is a view illustrating the configuration of a main balancer according to an embodiment of the present disclosure. FIG. 4 is a view illustrating the configuration of a main balancer, a first sub-balancer, and a second sub-main balancer according to an embodiment of the present disclosure. FIG. 5A is a plan view illustrating a first surface of a balancer guide according to an embodiment of the present disclosure. FIG. 5B is a plan view illustrating a second surface of a balancer guide according to an embodiment of the present disclosure.

Hereafter, the balancers and the balancer guide according to the embodiment are described with reference to FIGS. 2 to 5B.

The balancer unit 100 according to the embodiment is disposed at a side in the drum 44 and compensates for eccentricity that is generated when the drum 44 is rotated. The balancer unit 100 includes a plurality of balancers 110, 140, and 150 that compensate for eccentricity, which is generated when the drum 44 is rotated, at a side in the drum 44, and a balancer guide 50 that forms a space in which the plurality of balancers 110, 140, and 150 are moved.

The balancers 110, 140, and 150 according to the embodiment may include a main balancer 110 that reduces vibration of the drum 44 by moving in the opposite direction to eccentricity that is generated when the drum 44 is rotated, a first sub-balancer 140 of which the arrangement gap from the main balancer 110 is adjusted in accordance with the degree of eccentricity of the drum 44, and a second sub-balancer 150 of which the arrangement gap from the main balancer 110 is adjusted in the opposite direction of the first sub-balancer 140 with respect to the main balancer 110.

The main balancer 110 includes a main balancer housing 112 having an external shape moving in the balancer guide 50 forming a ring-shaped space. The main balancer housing 112 has an arc-shaped external shape and has a hollow portion to accommodate therein some components described below.

The main balancer 110 can actively move in the balancer guide 50. The main balancer 110 may include a balancer moving motor 114 for actively moving in the balancer guide 50, and a balancer moving member 116 being rotated by the balancer motor 114 and moving the main balancer 110.

The balancer moving motor 114 may be disposed in the main balancer housing 112. The balancer moving member 116 according to the embodiment has a pinion gear shape and moves the main balancer 110 in engagement with a first guide rail 54 to be described below. The balancer moving member 116 is disposed to partially protrude out of an inner surface 112*a* of the main balancer housing 112 forming a surface close to the center of the drum 44 at the lower portion of the inner surface 112*a*.

The main balancer 110 is connected with the first sub-balancer 140 and the second sub-balancer 150 and can control the gaps from the first sub-balancer 140 and the second sub-balancer 150. The main balancer 110 according to the embodiment includes a gap adjustment member 120 that adjusts the gaps from the first sub-balancer 140 and the second sub-balancer 150, and a gap adjustment motor 118 that rotates the gap adjustment member 120.

The gap adjustment motor 118 may be disposed in the internal space of the main balancer housing 112.

The gap adjustment member 120 according to the embodiment has a pinion gear shape and can adjust the gaps from the first sub-balancer 140 and the second sub-balancer 150 in engagement with a first connection member 144 of the first sub-balancer 140 and a second connection member 154 of the second sub-balancer 150 that will be described below.

The gap adjustment motor 120 may be disposed on the top 112*c* of the main balancer housing 112. The gap adjustment motor 120 according to the embodiment may be disposed inside a virtual surface formed by extending the inner surface 112*a* and the outer surface 112*b* of the main balancer housing 112. That is, the gap adjustment member 120 does not protrude inside the inner surface 112*a* and does not protrude outside the outer surface 112*b*.

The main balancer 110 according to the embodiment adjusts the positions of the first sub-balancer 140 and the second sub-balancer 150, using one gap adjustment motor 118 and one gap adjustment member 120. However, this is based on one embodiment, and two gap adjustment motors 118 and two gap adjustment members 120 that are engaged with the first sub-balancer 140 and the second sub-balancer 150, respectively, may be provided to separately adjust the positions of the first sub-balancer 140 and the second sub-balancer 150.

The main balancer 110 according to the embodiment may include an electronic part unit (not shown) forming a space in which electronic devices are disposed, a battery 122 supplying power to the electronic part unit, a balancer controller 124 controlling driving of the balancer moving motor 114 or the gap adjustment motor 118, and a balancer communication unit 126 (or balancer communication device) transmitting instructions from a main controller 60 to a balancer controller 124 by communicating with a main communication unit 62.

Electronic devices are disposed in the electronic part unit, that is, various electronic devices for driving the balancer moving motor 114 or the gap adjustment motor 118 may be disposed.

The battery 122 may be disposed inside the main balancer housing 112. The battery 122 may function as a component that applies load to the main balancer 110. The battery 122 can supply power for driving the balancer moving motor 114 and the gap adjustment motor 118.

Further, as a component that supplies power to the balancer moving motor 114 and the gap adjustment motor 118, other than the battery, a reception coil (not shown) that receives power in a wireless power type and supplies power to the components in the main balancer 110 may be included.

In this case, a transmission coil (not shown) that transmits power in a wireless type to the main balancer 110 may be disposed at a side in the tub 42, and the reception coil can generate power by inducing electromagnetism from a wireless power signal transmitted from the transmission coil. The balancer moving motor 114 and the gap adjustment motor 118 can generate power using the power generated by the reception coil.

The balancer controller 124 can change the position of the main balancer 110 by operating the balancer moving motor 114. Further, the balancer controller 124 can find out the position of the main balancer 110 by sensing the RPM of the balancer moving motor 114.

The balancer controller 124 can adjust the gap between the main balancer 110 and the first sub-balancer 140 and the gap between the main balancer 110 and the second sub-balancer 150 by operating the gap adjustment motor 118. Further, the balancer controller 124 can find out the positions of the first sub-balancer 140 and the second sub-balancer 150 by sensing the RPM of the gap adjustment member 120.

The balancer communication unit 126 can perform wireless communication with the main communication unit 62 using a wireless communication method such as Wi-Fi, Bluetooth, Zigbee, and NFC. The balancer communication unit 126 can transmit the positions of the balancers 110, 140, and 150 found out by the balancer controller 124 to the main controller 60.

The first sub-balancer 140 according to the embodiment includes a first sub-balancer housing 142 forming an external shape and moving in the internal space of the balancer guide 50, and the first connection member 144 extending along the balancer guide 50 from a side of the first sub-balancer housing 142 and connecting with the main balancer 110.

The first connection member 144 has a rack gear shape on the surface that is in contact with the gap adjustment member 120, thereby being engaged with the gap adjustment member 120. The gap between the first connection member 144 and the main balancer 110 can be adjusted by rotation of the gap adjustment member 120.

The second sub-balancer 150 according to the embodiment includes a second sub-balancer housing 152 forming an external shape and moving in the internal space of the balancer guide 50, and the second connection member 154 extending along the balancer guide 50 from a side of the second sub-balancer housing 152 and connecting with the main balancer 110.

The second connection member 154 has a rack gear shape on the surface that is in contact with the gap adjustment member 120, thereby being engaged with the gap adjustment member 120. The gap between the second connection member 154 and the main balancer 110 can be adjusted by rotation of the gap adjustment member 120.

The first connection member 144 and the second connection member 154 are in contact with the gap adjustment member 120 in different directions. The surface of the first connection member 144 being in contact with the gap adjustment member 120 and the surface of the second connection member 154 being in contact with the gap adjustment member 120 are disposed in parallel with each other.

The main balancer 110, the first sub-balancer 140, and the second sub-balancer 150 can be moved by the balancer moving motor 114 disposed in the main balancer 110. Accordingly, when the main balancer 110, the first sub-balancer 140, and the second sub-balancer 150 are moved by the balancer moving motor 114, the main balancer 110, the first sub-balancer 140, and the second sub-balancer 150 can be moved while maintaining their gaps.

The first sub-balancer 140 and the second sub-balancer 150 may have the same weight. The main balancer 110 has the same weight as the first sub-balancer 140 and the second sub-balancer 150 or may have larger weight than the first sub-balancer 140 and the second sub-balancer 150.

The balancer guide 50 forming a space in which the balancers 110, 140, and 150 are moved is formed at the upper portion of the drum 44 according to the embodiment. The balancer guide 50 has an annular shape and forms therein a space in which the balancers 110, 140, and 150 are moved.

The balancer guide 50 has a first surface portion 52 having a surface facing the bottoms of the main balancer 110, the first sub-balancer 140, and the second sub-balancer 150, and a second surface portion 56 having a surface facing the tops of the main balancer 110, the first sub-balancer 140, and the second sub-balancer 150.

The first surface portion 52 has at least a bottom 52*a* of surfaces formed inside the balancer guide 50 and the second surface portion 56 has at least a top 56*a* of the surfaces formed inside the balancer guide 50.

A first guide rail 54 is engaged with the balancer moving member 116 of the main balancer 110 and guides movement of the main balancer 110 by rotation of the balancer moving member 116. The first guide rail 54 may have a rack gear shape that is engaged with the balancer moving member 116 having a pinion gear shape. The first guide rail 54 may be formed on a surface facing the inner surface 112*a* of the main balancer 110.

A second guide rail 58 that guides movement of the first sub-balancer 140 and the second sub-balancer 150 is formed on the second surface portion 56. The second guide rail 58 may protrude downward from the top of the inner surface of the balancer guide 50. Guide grooves 146 and 156 corresponding to the second guide rail 58 may be formed respectively on the tops of the first sub-balancer 140 and the second sub-balancer 150.

The second guide rail 58 may have a ring shape. The second guide rail 58 can prevent contact of the first sub-balancer 140 and the second sub-balancer 150 with the first guide rail 54.

<Related to Controllers>

Figure 6:
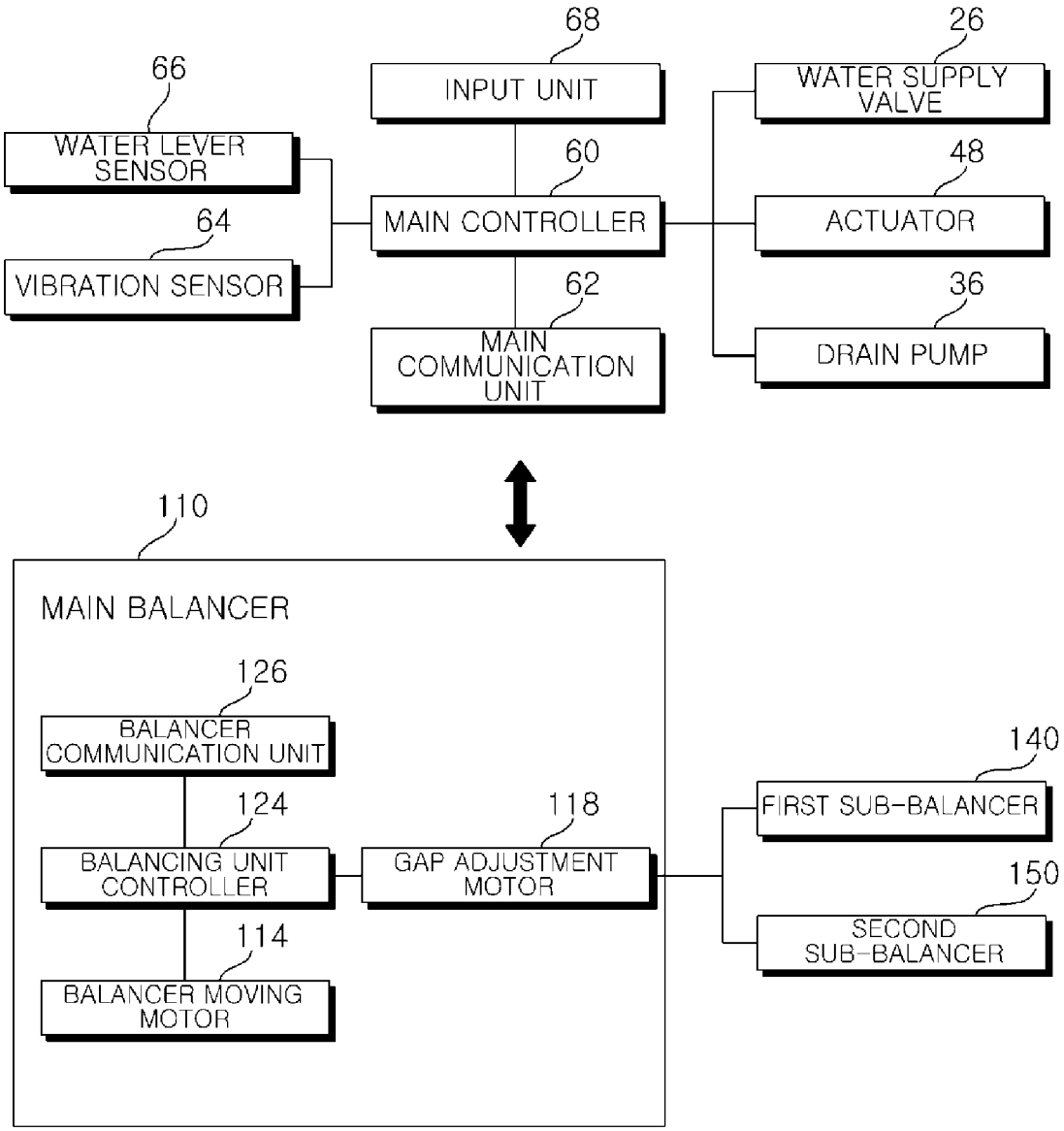
FIG. 6 is a block diagram illustrating a main controller, a balancer controller, and relevant components according to an embodiment of the present disclosure.

FIG. 6 is a block diagram illustrating a main controller, a balancer controller, and relevant components according to an embodiment of the present disclosure. Hereafter, the main controller, the balancer controller, and the relevant components according to an embodiment of the present disclosure are described with reference to FIG. 6.

The laundry treatment machine 10 according to the embodiment includes the main controller 60 that controls the general operation of the laundry treatment machine 10 in accordance with operation instructions that an input unit 68 receives.

The main controller 60 may be composed of a micom, which controls the operation of the laundry treatment machine 10, a storage device, and other electronic parts. The main controller 60 can control the water supply valve 26, the actuator 48, and the drain pump 36 by determining whether to perform each course in accordance with washing courses selected by a user, whether to perform operations of water supply, washing, rinsing, draining, spinning, drying, etc. in each course, time of the operations, and the number of times of repeating the operations, etc. The main controller 60 can control the water supply valve 26, the actuator 48, and the drain pump 36 in accordance with the amount of fabrics that is the weight of the fabrics measured at the early state of washing, and the water level in the tub 42 measured by a water level sensor 66.

The laundry treatment machine 10 according to the embodiment may include a vibration sensor 64 that senses the amount of vibration of the tub 42, a water level sensor 66 that senses the level of washing water supplied in the tub 42, and a main communication unit 62 (or main communication device) that collects information of the balancers 110, 140, and 150 or transmits instructions from the main controller 60 to the main balancer 110.

As for the vibration sensor 64, a plurality of vibration sensors 64 may be provided in the tub 42 to sense the amount of vibration of the tub 42. Vibration due to unbalance of the drum 44 is transmitted to the tub 42 through a rotary shaft, thereby causing vibration of the tub 42. The plurality of vibration sensors 64 can measure the degree of unbalance of the drum 44 by sensing the amount of vibration of the tub 42.

The vibration sensor 64 may be implemented as various sensors that sense the amount of vibration of the tub 42. In the embodiment, the vibration sensor 64 may be an optical sensor disposed in the tub 42 and measuring the distance from the case 12.

In the embodiment, the vibration sensor 64 senses the degree of vibration through a change of the distance between the case 12 and the tub 42. In the embodiment, the vibration sensor 64 may include a first vibration sensor that is disposed at the upper portion of the tub 42 and senses an upper vibration amount that is the amount of vibration of the upper portion of the tub 42, and a second vibration sensor that is disposed at the lower portion of the tub 42 and senses a lower vibration amount that is the amount of vibration of the lower portion of the tub 42.

The main communication unit 62 can find out position information of the balancers through wireless communication with the balancer communication unit 126 or can transmit instructions from the main controller 60 to the balancer controller 124. The main communication unit 62 can communicate with the balancer communication 126 using a wireless communication method such as Wi-Fi (Wireless Fidelity), Bluetooth, Zigbee, Near Field Communication (NFC), etc.

The main controller 60 can control the main balancer 110, the first sub-balancer 140, and the second sub-balancer 150 in accordance with the amount of vibration of the tub 42 measured by the first vibration sensor 64 and the second vibration sensor 64.

Further, the main controller 60 can control the main balancer 110, the first sub-balancer 140, and the second sub-balancer 150 on the basis of a current value that is applied to the actuator 48 when the drum 44 is rotated.

The main controller 60 can find out the position of the main balancer 110 through the main communication unit 62, and can control the position of the main balancer 110. In the same way, the main controller 60 can find out the positions of the first sub-balancer 140 and the second sub-balancer 150 through the main communication unit 62, and can control the positions of the first sub-balancer 140 and the second sub-balancer 150.

<Operation of Balancers>

Figure 7:
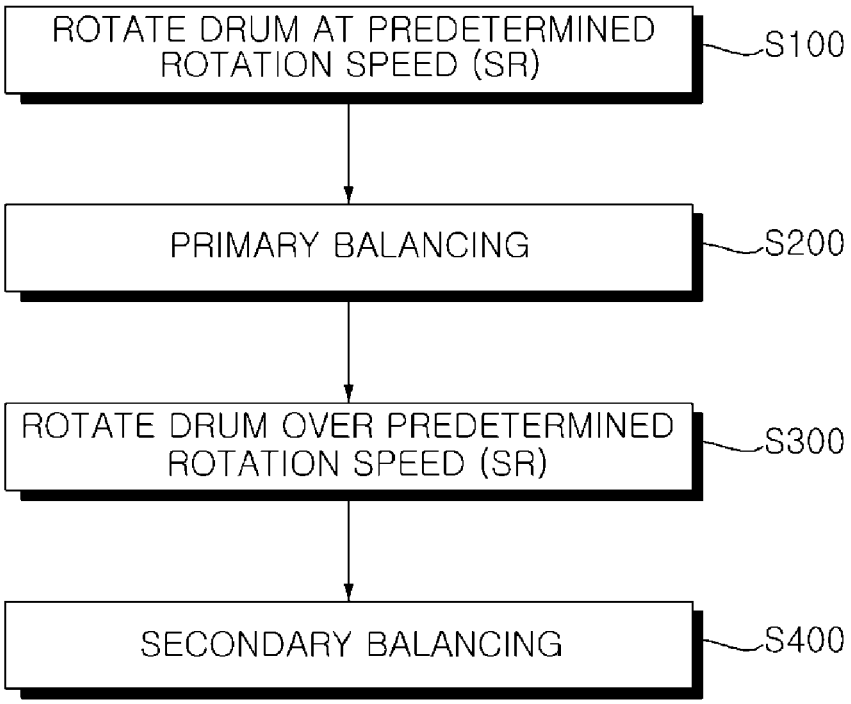
FIG. 7 is a flowchart of a method of controlling a laundry treatment machine according to an embodiment of the present disclosure.
Figure 8A:
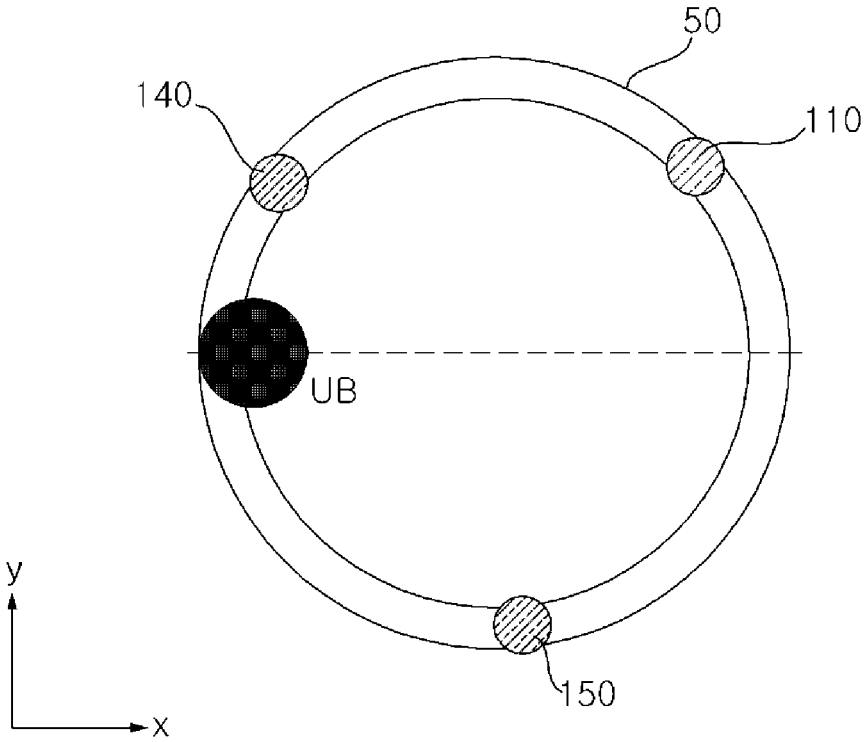
FIG. 8A is a view showing arrangement of the main balancer, the first sub-balancer, and the second sub-balancer before primary balancing.
Figure 8B:
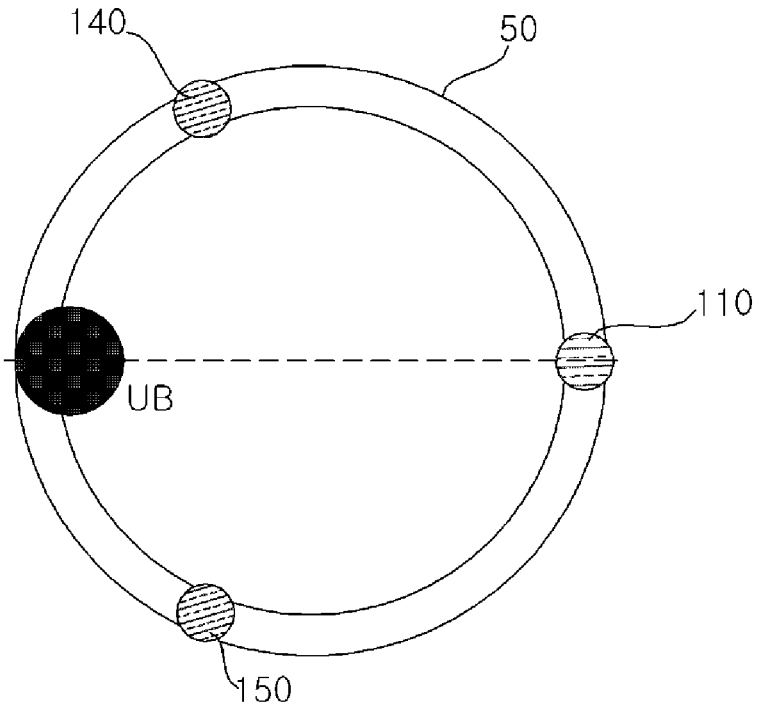
FIG. 8B is a view showing arrangement of the main balancer, the first sub-balancer, and the second sub-balancer that have been primarily balanced.
Figure 8C:
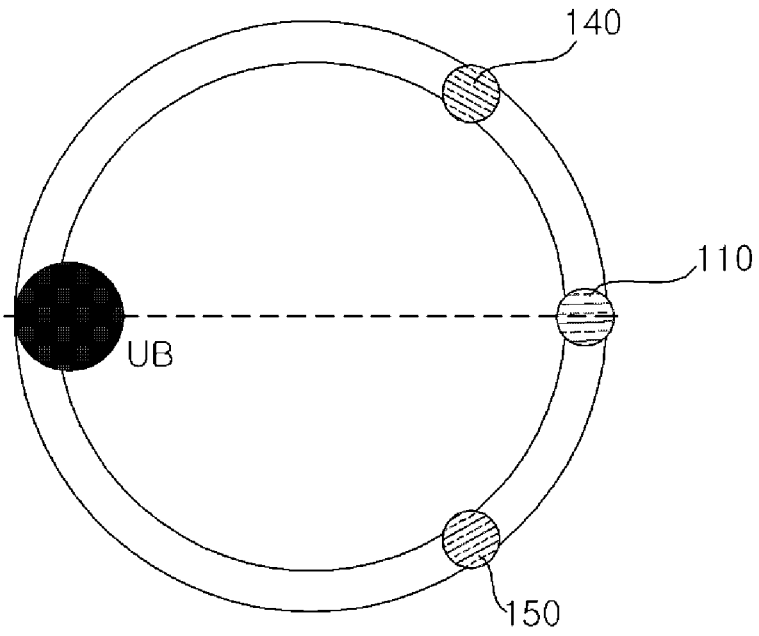
FIG. 8C is a view showing arrangement of the main balancer, the first sub-balancer, and the second sub-balancer that are secondarily balanced.
Figure 9:
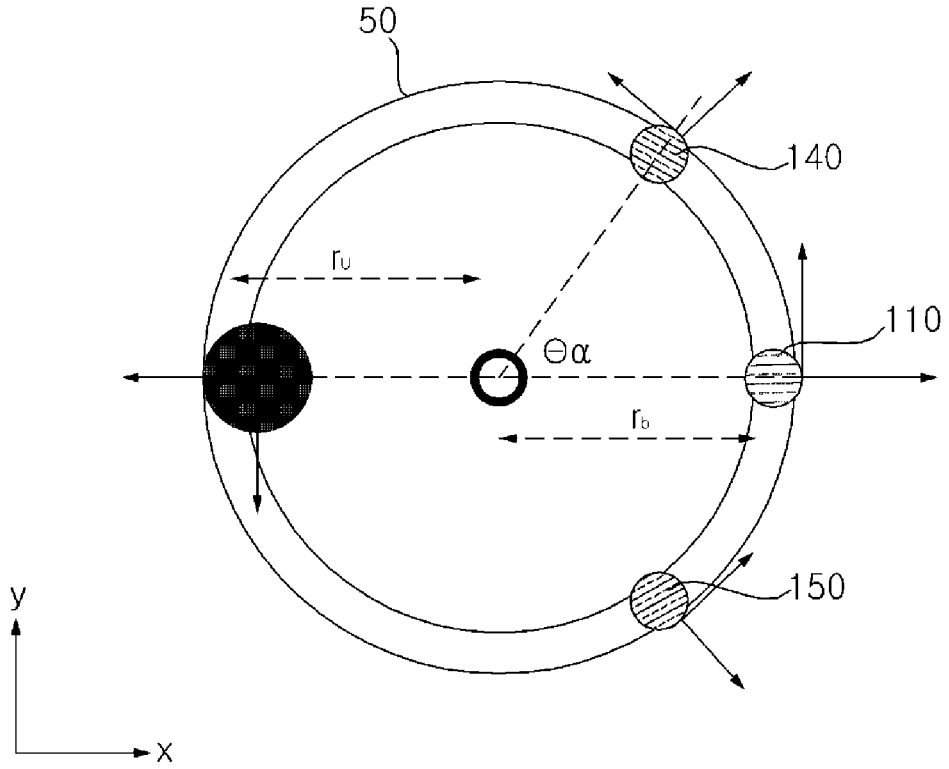
FIG. 9 is a view illustrating the angle made by the main balancer and the first sub-balancer at the center of a drum in a force balance relationship of the drum, an eccentric portion UB, the main balancer, the first sub-balancer, and the second sub-balancer according to an embodiment of the present disclosure.
Figure 10:
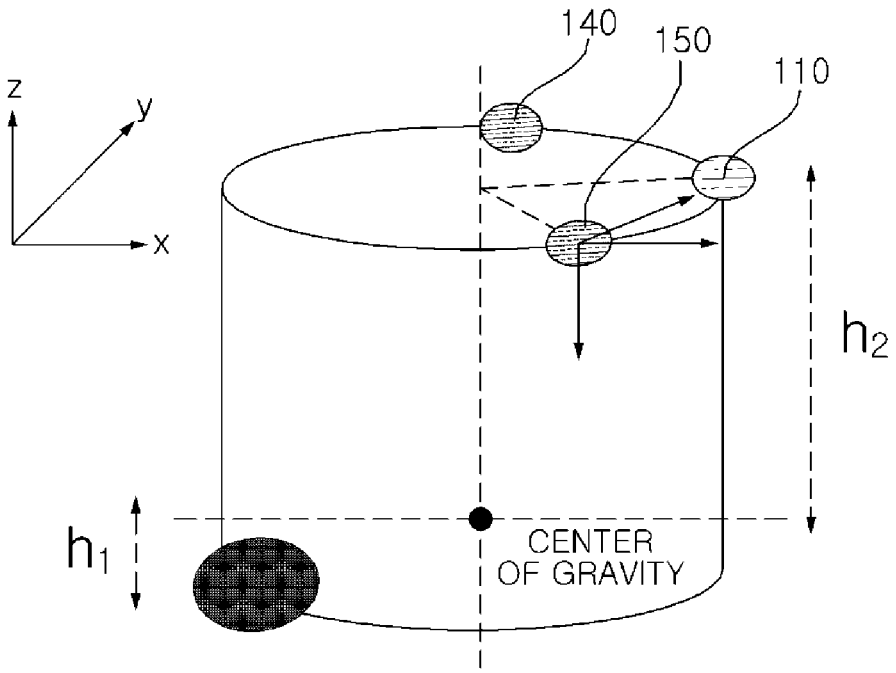
FIG. 10 is a view illustrating the angle made by the main balancer and the first sub-balancer at the center of a drum in a moment balance relationship of the drum, the eccentric portion UB, the main balancer, the first sub-balancer, and the second sub-balancer according to an embodiment of the present disclosure.

FIG. 7 is a flowchart of a method of controlling a laundry treatment machine according to an embodiment of the present disclosure. FIG. 8A is a view showing arrangement of the main balancer, the first sub-balancer, and the second sub-balancer before primary balancing. FIG. 8B is a view showing arrangement of the main balancer, the first sub-balancer, and the second sub-balancer that have been primarily balanced. FIG. 8C is a view showing arrangement of the main balancer, the first sub-balancer, and the second sub-balancer that are secondarily balanced. FIG. 9 is a view illustrating the angle made by the main balancer and the first sub-balancer at the center of a drum in a force balance relationship of the drum, an eccentric portion UB, the main balancer, the first sub-balancer, and the second sub-balancer according to an embodiment of the present disclosure. FIG. 10 is a view illustrating the angle made by the main balancer and the first sub-balancer at the center of a drum in a moment balance relationship of the drum, the eccentric portion UB, the main balancer, the first sub-balancer, and the second sub-balancer according to an embodiment of the present disclosure.

Hereafter, a method of controlling the laundry treatment machine that compensates for eccentricity using the main balancer 110, the first sub-balancer 140, and the second sub-balancer 150 when eccentricity is generated in the laundry treatment apparatus according to the embodiment is described with reference to FIGS. 7 to 10.

The method of controlling the laundry treatment machine according to the embodiment performs a step of rotating the drum S44 at a predetermined rotation speed SR (S100). The step of rotating the drum 44 may be performed usually in a spinning process that removes water that laundry has, but may be applied to a washing process or a ringing process.

The predetermined rotation speed SR may be set within a range that is lower than a target drum rotation speed TR without an excessive amount of vibration.

Thereafter, when the drum is rotated at the predetermined rotation speed SR, a primary balancing step (S200) may be performed.

In the primary balancing step (S200), the main balancer 110 is positioned toward the center of gravity (hereafter, an eccentric portion UB) where eccentricity by laundry acts. That is, the arrangement of the main balancer 110 shown in FIG. 8A is moved, as shown in FIG. 8B.

At the initial position where the primary balancing step (S200) is performed, the gap between the main balancer 110 and the first sub-balancer 140 is the same as the gap between the main balancer 110 and the second sub-balancer 150. The weight of the main balancer 110 according to the embodiment may be larger than the weights of the first sub-balancer 140 and the second sub-balancer 150. At the initial position according to the embodiment, the center of gravity by the main balancer 110, the first sub-balancer 140, and the second sub-balancer 150 may be positioned to be finely eccentric toward the main balancer 110.

In the primary balancing step (S200), the main balancer 110 is moved clockwise or counterclockwise and the current value of the actuator 48 is measured. The main balancer 110 is moved to a point where the current value is minimum.

That is, when the current value increases due to movement of the main balancer 110 in one direction, the main balancer 110 is moved to a section where the current value decreases. When the current value decreases due to movement of the main balancer 110 in one direction, the main balancer 110 is stopped at a breakpoint.

In the primary balancing step (S200), the main balancer 110 is moved while maintaining the gaps from the first sub-balancer 140 and the second sub-balancer 150.

The main controller 60 can find out the phase and weight information of the eccentric portion UB from the vibration sensor 64 and can move the position of the main balancer 110 in the opposite direction to the eccentric portion UB on the basis of the found phase of the eccentric portion UB. In this case, the weights of the main balancer 110, the first sub-balancer 140, and the second sub-balancer 150 may be set to be the same.

After the primary balancing step (S200), a step of rotating the drum 44 over the predetermined rotation speed (S300) is performed. The rotation speed of the drum 44 in this step may be a target rotation speed of the drum 44. However, it may be possible to rotate the drum 44 at another predetermined rotation speed under the target value.

Thereafter, when the drum is rotated over the predetermined rotation speed SR, a secondary balancing step (S400) is performed.

In the secondary balancing step (S400), the gap between the main balancer 110 and the first sub-balancer 140 and the gap between the main balancer 110 and the second sub-balancer 150 are adjusted. The main controller 60 adjusts the positions of the first sub-balancer 140 and the second sub-balancer 150 by operating the gap adjustment motor 118. That is, the arrangement of the first sub-balancer 140 and the second sub-balancer 150 shown in FIG. 8B is adjusted, as shown in FIG. 8C.

When the gap adjustment motor 118 is rotated in one direction, the first sub-balancer 140 and the second sub-balancer 150 can move closer to the main balancer 110. Further, when the gap adjustment motor 118 is rotated in another direction, the first sub-balancer 140 and the second sub-balancer 150 can move away from the main balancer 110.

The main controller 60 rotates the gap adjustment motor 118 in a direction in which a current value decreases by measuring that current value applied to the actuator 48. That is, when the gap adjustment motor 118 is rotated in one direction and the current value applied to the actuator 48 increases, the main controller 60 rotates the gap adjustment motor 118 in another direction. Further, when the gap adjustment motor 118 is rotated in one direction and the current value applied to the actuator 48 decreases, the main controller 60 stops the gap adjustment motor 118 at a breakpoint where the current value increases again.

The main controller 60 can find out the phase and weight information of the eccentric portion UB from the vibration sensor 64 and can adjust the gaps between the main balancer 110, the first sub-balancer 140, and the second sub-balancer 150 on the basis of the found weight information of the eccentric portion UB.

That is, referring to FIG. 9, it is possible to find out the angle $\theta_{a\ st}$ between the main balancer 110 and the first sub-balancer 140 around the center of the drum 44 in a static state on the basis of force balance acting on the drum 44.

That is, since the resultant force acting in the x-axial direction is 0, the following Formula 1 is established.

$$m_u\dot{r}_u - m_u r_u\dot{\theta}^2 = m_{b1}\dot{r}_b - m_{b1}r_b\dot{\theta}^2 + 2\cos\theta_{a\ st}(m_{b2}\dot{r}_b = m_{b2}r_b\dot{\theta}^2) \quad \text{<Formula 1>}$$

Since the resultant force acting in the y-axial direction is 0, the following Formula 2 is established.

$$m_u r_u\ddot{\theta} + 2m_u\dot{r}_u\dot{\theta} = m_{b1}r_b\ddot{\theta} + 2m_{b1}\dot{r}_b\dot{\theta} + 2\cos\theta_{a\ st}(m_{b2}r_b\ddot{\theta} + m_{b2}\dot{r}_b\dot{\theta}) \quad \text{<Formula 2>}$$

(where $m_u$ is the weight of the eccentric portion UB found out from the vibration sensor 64, $m_{b1}$ is the weight of the main balancer 110, $m_{b2}$ is the weights of the first sub-balancer 140 and the second sub-balancer 150, $\theta$ is the rotation angle of the actuator 48, $\theta_{a\ st}$ is the angle between the main balancer 110 and the first sub-balancer 140, $r_b$ is the distance from the drum 44 to the balancers 110, 140, and 150, and $r_u$ is the distance from the center of the drum 44 to the eccentric portion UB)

From Formula 1 and Formula 2, in the static state, it is possible to find out the angle $\theta_{a\ st}$ between the main balancer 110 and the first sub-balancer 140 around the center of the drum 44.

Further, referring to FIG. 10, it is possible to find out the angle $\theta_{a_dy}$ between the main balancer 110 and the first sub-balancer 140 around the center of the drum 44 in a dynamic state on the basis of moment balance acting the drum 44.

That is, since the resultant moment acting in the x-axial direction is 0, the following Formula 3 is established.

$$m_u r_u(-2\ddot{h}_1) = r_b 2\ddot{\Theta}h_2(m_{b1} + 2m_{b2}\cos\theta_{a_dy}) \quad \text{<Formula 3>}$$

Since the resultant moment acting in the y-axial direction is 0, the following Formula 4 is established.

$$m_u r_u(g + 2\dot{\Theta}^2 h_1) = r_b(m_{b1}(g - 2\dot{\Theta}^2 h_2) + 2m_{b2}(g\cos\Theta_{a_dy} - -2\dot{\Theta}^2 h_2\cos\Theta_{a_dy})) \quad \text{<Formula 4>}$$

(where, g is acceleration of gravity, $h_1$ is the height between the center of gravity of the drum 44 and the eccentric portion UB, and $h_2$ is the height between the center of gravity of the drum 44 and the balancers 110, 140, and 150).

From Formula 3 and Formula 4, in the dynamic state, it is possible to find out the angle $\theta_{a_dy}$ between the main balancer 110 and the first sub-balancer 140 around the center of the drum 44.

The angle $\theta_a$ of the first sub-balancer 140 and the second sub-balancer 150 can be controlled using the following Formula 5 on the basis of the angle $\theta_{a_st}$ between the main balancer 110 and the first sub-balancer 140 around the center of the drum in the static state and the angle $\theta_{a_dy}$ between the main balancer 110 and the first sub-balancer 140 around the center of the drum in the dynamic state.

$$\theta_a = B*\theta_{a_{st}} + (1-B)*\theta_{a_dy} \quad \text{<Formula 5>}$$

Although exemplary embodiments of the present disclosure were illustrated and described above, the present disclosure is not limited to the specific exemplary embodiments and may be modified in various ways by those skilled in the art without departing from the scope of the present disclosure described in claims, and the modified examples should not be construed independently from the spirit of the scope of the present disclosure.

According to a laundry treatment machine and a control method thereof of the present disclosure, one or more effects can be achieved as follows.

First, since a main balancer and two sub-balancers are controlled by one main balancer, it is possible to reduce the electronic parts additionally required when controlling a plurality of balancers with one balancer.

Second, it is possible to precisely adjust movement and gaps of a main balancer and two sub-balancers using a balancer moving motor and a gap adjustment motor.

Third, since it is possible to control a main balancer and sub-balancers on the basis of a current value that is applied to an actuator, there is no specific sensor for finding out vibration of a drum and a tub and reducing the amount of vibration, so there is an advantage that the cost is reduced.

The effects of the present disclosure are not limited to those described above and other effects not stated herein may be made apparent to those skilled in the art from claims.

The present disclosure provides a laundry treatment machine that precisely compensates for eccentricity that is generated when a drum is rotated.

The present disclosure also provides a laundry treatment machine that compensates for eccentricity due to rotation of a drum using a current value that is applied to an actuator without a specific sensor.

The objects of the present disclosure are not limited to the objects described above and other objects will be clearly understood by those skilled in the art from the following description.

In an aspect, a laundry treatment machine includes: a tub that has a cylindrical shape with an open side; a drum that has an inlet hole for putting/taking laundry in/out in the same direction as the tub and is rotatably disposed in the tub; an actuator that provides power for rotating the drum; and a balancer unit that is disposed at an end where the inlet hole of the drum is formed, and adjusts the center of gravity of the drum that is rotating, in which the balancer unit includes: a main balancer that reduces vibration of the drum by moving in the opposite direction to eccentricity that is generated when the drum is rotated; a first sub-balancer of which an arrangement gap from the main balancer is adjusted in accordance with the degree of eccentricity of the drum; and a second sub-balancer of which an arrangement gap from the main balancer is adjusted in the opposite direction of the first sub-balancer with respect to the main balancer. Accordingly, it is possible to compensate for eccentricity with the main balancer and the two sub-balancers.

The first sub-balancer and the second sub-balancer have the same weight and are spaced apart the same gap from the main balancer.

The balancer unit includes a balancer guide disposed at the end where the inlet hole of the drum is disposed, and forming an annular space in which the main balancer, the first sub-balancer, and the second sub-balancer are moved.

The balancer moving unit includes: a first guide rail that guides movement of the main balancer; and a second guide rail that guides the first sub-balancer and the second sub-balancer to move without coming in contact with the first guide rail. Accordingly, the main balancer and the sub-balancers can be smoothly moved.

The first sub-balancer includes a first connection member connected with the main balancer to adjust a gap from the main balancer, and the second sub-balancer includes a second connection member connected with the main balancer to adjust a gap from the main balancer. Accordingly, it is possible to adjust the positions of three balancers using one main balancer.

The main balancer includes: a gap adjustment member rotating in engagement with the first connection member and the second connection member; and a gap adjustment motor rotating the gap adjustment member. Accordingly, it is possible to adjust the positions of three balancers using one main balancer.

The first connection member and the second connection member have a rack gear shape, the gap adjustment member has a pinion gear shape, and the first connection member and the second connection member are engaged with the gap adjustment member in different directions. Accordingly, it is possible to adjust the positions of three balancers using one main balancer.

In another aspect, a method of controlling a laundry treatment machine includes: rotating a drum at a predetermined rotation speed using an actuator; measuring a current value that is applied to the actuator when the drum is rotated at the predetermined rotation speed; primary balancing of moving a main balancer in an opposite direction to an eccentric portion that is generated by laundry in the drum; and secondary balancing of adjusting a position of a first sub-balancer spaced apart from the main balancer in a direction, and adjusting a position of a second sub-balancer spaced apart from the main balancer in another direction. Accordingly, it is possible to compensate for eccentricity by adjusting the position of the main balancer and gaps of the sub-balancers.

The method further includes rotating the drum over the predetermined rotation speed after the primary balancing, in which the secondary balancing is performed when the drum is rotated over the predetermined rotation speed. Accordingly, it is possible to compensate for eccentricity even though the rotation speed of the drum increases.

The primary balancing adjusts a position of the main balancer on the basis of the current value that is applied to the actuator, in detail, stops the main balancer at a breakpoint where the current value that is applied to the actuator increases after decreasing when the main balancer is rotated in a direction. Accordingly, it is possible to reduce eccentricity.

A gap between the first sub-balancer and the main balancer is maintained to be the same as a gap between the second sub-balancer and the main balancer.

The secondary balancing adjusts positions of the first sub-balancer and the second sub-balancer on the basis of the current value that is applied to the actuator, in detail, moves the first sub-balancer and the second sub-balancer in a direction in which the current value that is applied to the actuator decreases, and stops the first sub-balancer and the second sub-balancer at a breakpoint where the current value that is applied to the actuator increases after decreasing. Accordingly, it is possible to compensate for eccentricity.

The details of other exemplary embodiments are included in the following detailed description and the accompanying drawings.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A laundry treatment machine comprising:

a tub;

a drum rotatably disposed in the tub;

an actuator to provide power for rotating the drum; and a balancer device to reduce vibration of the drum, wherein the balancer device includes:

a balancer guide having an annular space;

a main balancer that moves in the annular space of the balancer guide;

a first sub-balancer that moves in the annular space relative to the main balancer, and the first sub-balancer to change a first gap from the main balancer based on eccentricity of the drum; and a second sub-balancer that moves in the annular space relative to the main balancer, and the second sub-balancer to change a second gap from the main balancer, wherein the second sub-balancer is disposed in a direction opposite to a direction in which the first sub-balancer is disposed based on the main balancer.

2. The laundry treatment apparatus of claim 1, wherein the first sub-balancer and the second sub-balancer have a same weight, and the first gap is a same distance as the second gap.

3. The laundry treatment machine of claim 1, wherein the balancer device includes:

a first guide rail that guides movement of the main balancer; and a second guide rail that guides movement of the first sub-balancer and the second sub-balancer without contacting the first guide rail.

4. The laundry treatment machine of claim 1, wherein the first sub-balancer includes a first connection member to connect with the main balancer and to change the first gap from the main balancer, and the second sub-balancer includes a second connection member to connect with the main balancer and to change the second gap from the main balancer.

5. The laundry treatment machine of claim 4, wherein the main balancer includes:

a gap adjustment member to rotate and engage with the first connection member and the second connection member; and a gap adjustment motor to rotate the gap adjustment member.

6. The laundry treatment machine of claim 5, wherein the first connection member has a rack gear, and the second connection member has a rack gear, the gap adjustment member has a pinion gear, and the first connection member is to engage with the gap adjustment member from a first direction, and the second connection member is to engage with the gap adjustment member from a second direction different from the first direction.

7. The laundry treatment machine of claim 1, wherein the balancer device includes the balancer guide disposed at an end where an inlet hole of the drum is disposed, and forming the annular space in which the main balancer, the first sub-balancer, and the second sub-balancer are moved.

* * * * *